US005475928A

United States Patent [19]

Augustin

[11] Patent Number: 5,475,928

[45] Date of Patent: Dec. 19, 1995

[54] CUTTER ASSEMBLY

[76] Inventor: Georg Augustin, 41 Waldweg Dr., Sparrowbush, N.Y. 12780

[21] Appl. No.: 174,980

[22] Filed: Dec. 29, 1993

[51] Int. Cl.[6] ..... B26B 3/08

[52] U.S. Cl. ..... 30/294; 30/317; 30/337; 30/2; 30/123

[58] Field of Search ..... 30/2, 286, 293, 30/294, 314, 317, 320, 329, 337, 123

[56] References Cited

U.S. PATENT DOCUMENTS

| | | | |
|---|---|---|---|
| 3,432,926 | 3/1969 | Kristal | 30/294 |
| 4,139,939 | 2/1979 | Crooks | 30/2 |
| 4,620,368 | 11/1986 | Bowman | 30/294 |

*Primary Examiner*—Rinaldi I. Rada
*Assistant Examiner*—Jay A. Stelacone
*Attorney, Agent, or Firm*—Ostrolenk, Faber, Gerb & Soffen

[57] ABSTRACT

A cutter assembly which includes a support, a recess in the support, a slot formed within the recess for receiving a cutting blade having a cutting edge such that only the tip of the cutting edge extends from the support. A U-shaped channel adjacent to the slot defines a flexible finger in engagement with the blade. A cover plate shaped to fit within the recess retains the blade within the slot. The cover plate has a pin projecting therefrom which is dimensioned to be received within a distal leg of the U-shaped channel so as to maintain the finger in engagement with the blade and at least one projecting button for engagement with the surface of the blade to retain the blade within the slot.

15 Claims, 3 Drawing Sheets

CUTTER ASSEMBLY

BACKGROUND OF THE INVENTION

The present invention relates to cutting implements and more particularly to a small cutting implement which may be used for cutting paper or similar thin materials.

There has long been a need for a simple and handy tool for cutting the top sheet of a pile of papers or similar materials. In particular, it is often desirable to cut the top page of a newspaper or a magazine which one is reading without cutting the pages below, for example, to cut out a valuable coupon or an interesting article. It is also desirable to be able to cut a coupon from a bond.

A conventional cutting tool, such as a pair of scissors, is often not available and in many situations is not even practical. For example, to use scissors to remove a small clipping from the center of a page, one must either start the cut from the nearest edge of the paper or stab the page near the desired article in order to begin the cut.

A simple device such as a single edge razor blade might be useful in some instances, but there would obviously be little to prevent the user from cutting not only the top sheet, but also one or more sheets below it. In addition, a bare razor can be quite dangerous.

Tools specifically designed for cutting articles out of newspapers have been suggested in the past. For the most part, these tools have been mechanically complex and consequently quite expensive to manufacture and to purchase. Many of these prior cutting tools have had sharp pointy blades which protrude from the tool in a dangerous fashion. This inherently dangerous feature has made such tools particularly inappropriate for use by children.

A further problem with many earlier cutting tools has been the necessity of orienting the tool relative to the paper and maintaining that orientation while moving the tool along the line to be cut. This is often difficult and awkward and may make it difficult to see the area on the paper which one desires to cut.

SUMMARY OF THE INVENTION

Accordingly, it is an object of the present invention to provide a cutter assembly for cutting the top sheet of a pile of papers which is lightweight, small, portable, inexpensive and easily and accurately usable.

In accordance with the present invention, the foregoing and other objects are achieved by a cutter assembly which includes a support having a recess therein for receiving a cutting blade having a cutting edge formed at one end. The recess in the support is shaped to receive the blade such that only a portion of the cutting edge extends from the support. Means including a flexible finger formed integrally in the support are provided for urging the cutting blade outward of the support and means are provided for retaining the blade in the recess.

Other features and advantages of the present invention will become apparent from the following description of the invention which refers to the accompanying drawings.

DETAILED DESCRIPTION OF THE INVENTION

Figure 1:
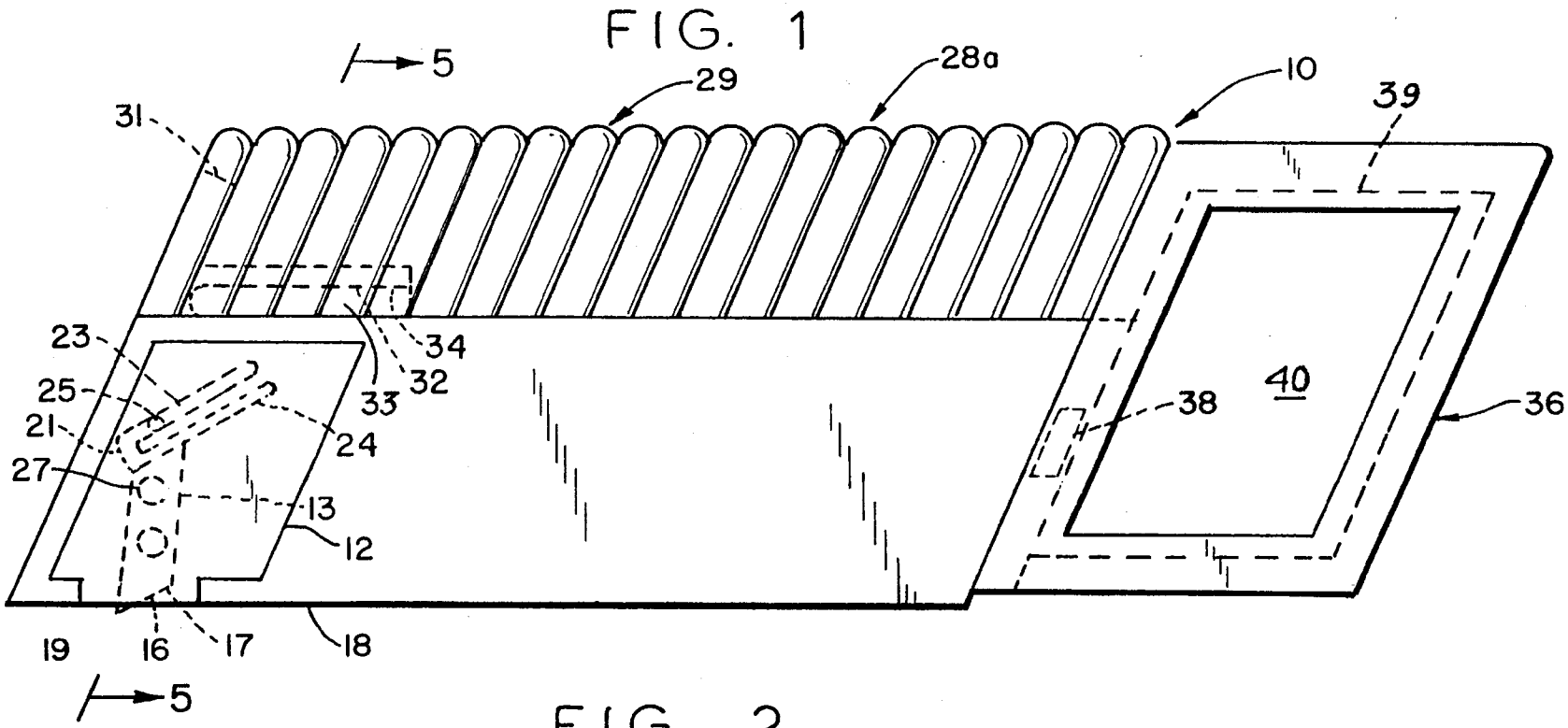
FIG. 1 is elevational view of a cutter assembly illustrating certain principles of the present invention.
Figure 2:
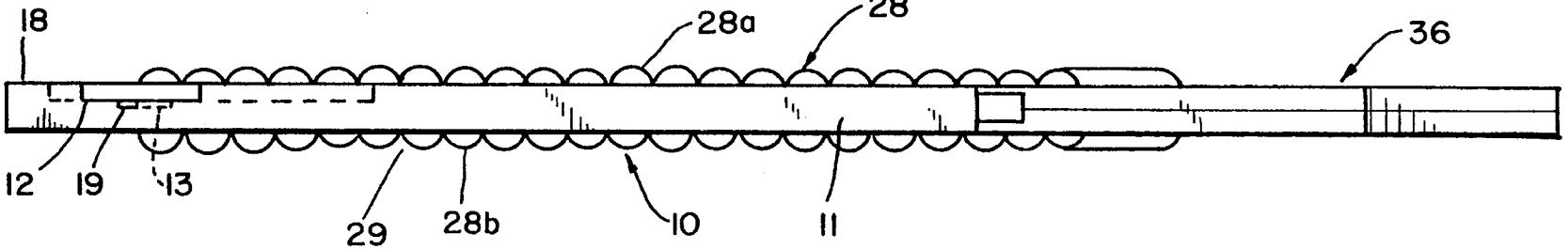
FIG. 2 is a bottom view of the cutter assembly shown in FIG. 1.
Figure 3:
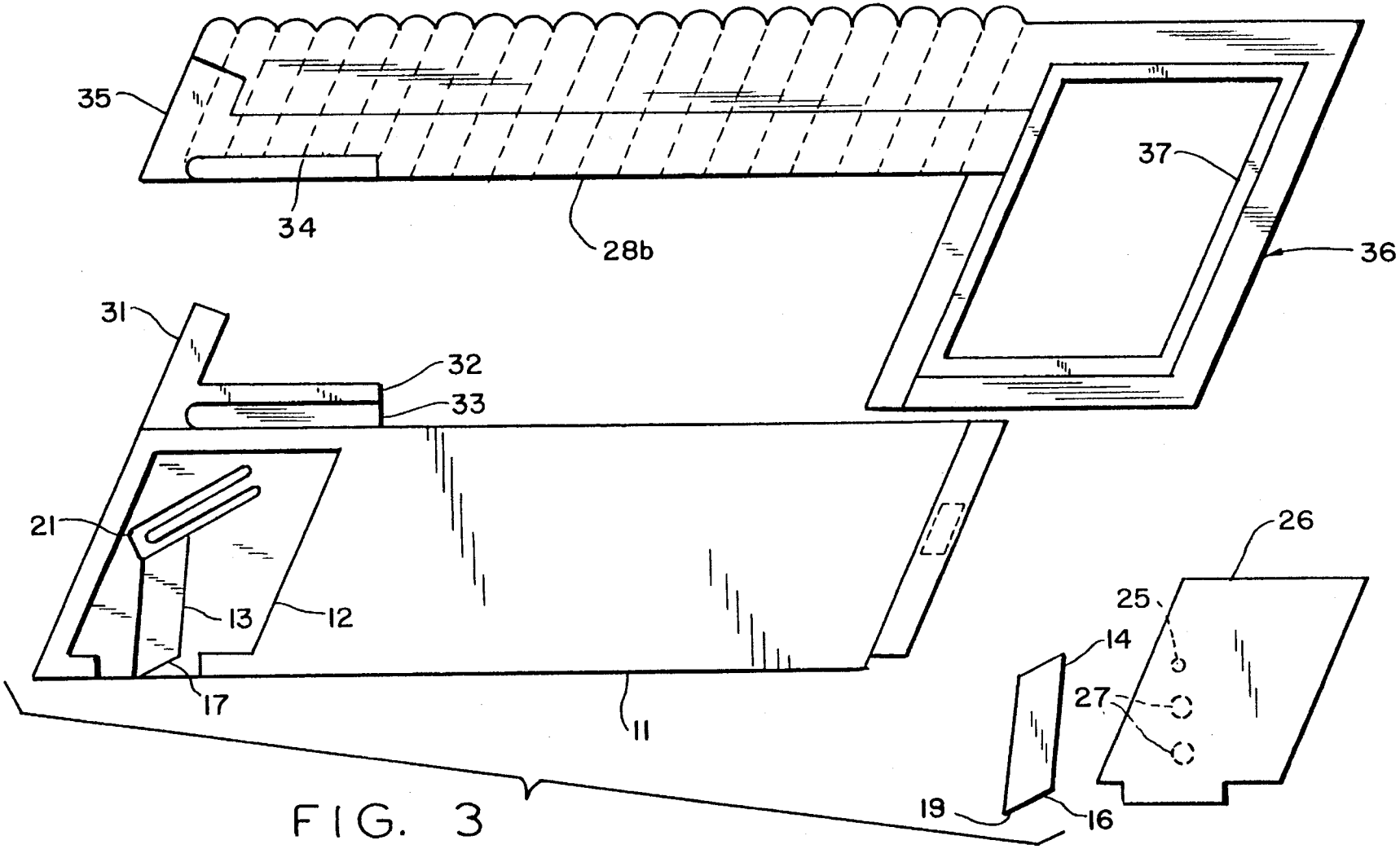
FIG. 3 is an exploded view of the cutter assembly of FIG. 1.

Referring now to the drawings and particularly to FIG. 1, there is shown a cutter assembly 10 which includes a support 11 having a recess 12 formed adjacent one end thereof. Formed within the recess 12 is a trapezoidal slot 13 for receiving a similarly shaped blade 14 having a cutting edge 16 at one end. The end wall 17 of the slot 13 is open at the bottom edge 18 of the support 11 so that, when the blade 14 is positioned in the slot 13, the tip 19 of the blade 14 projects from the support. Just above the slot 13, the support 11 includes a U-shaped channel 21 which extends therethrough thereby forming a flexible finger 22 which extends over the slot. The legs 23 and 24 of the channel 21 are angled such that the flexible finger 22 is at the same angle as the angle of the facing end of the blade 14, and the flexible finger 22 is spaced from the end of the slot 13 such that when the blade is received in the slot, the flexible finger engages the facing end of the blade against the end wall 17 of the slot 13 and urges the blade outwardly of the support, that is, downwardly as shown in FIGS. 1 and 3–5.

A cover plate or retainer 26 having the same shape as the recess 12 and a thickness equal to the depth of the recess snaps into the recess to retain the blade 14 in the slot 13. The support 11 is advantageously formed of plastic or a similar material having relative resiliency, to impart the requisite flexibility to the flexible finger 22. In order to maintain the blade 14 in the cutting position when in use, that is, to prevent the reactive force when the blade is cutting from causing the blade to move upwardly in the slot 13, the retainer 26 includes a pin 25 which is dimensioned to fit into the upper leg 23 of the channel 21 when the retainer 26 is snapped into the recess thereby precluding the flexible finger 22 from moving upwardly. In turn, this precludes the blade 14 from moving upwardly and maintains the tip 19 of the blade extending approximately 0.005 inches from the bottom edge 18 of the support.

Figure 5:
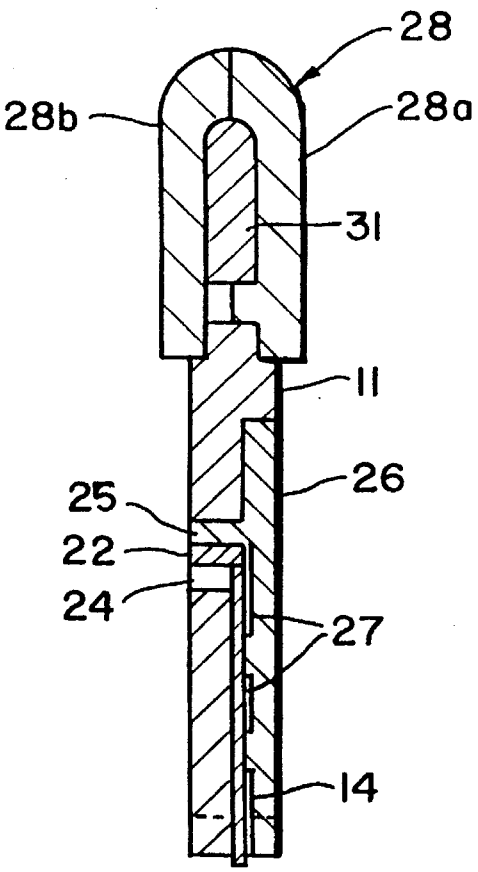
FIG. 5 is a section taken along the lines 5—5 of FIG. 1.

As best seen in FIG. 5, the thickness of the blade 14 is somewhat less than the thickness of the slot 13, and, accordingly, in order to help retain the blade in the slot when the retainer 26 is snapped into the recess, the retainer may include a pair of depending buttons 27 which bear against the blade and assure retention thereof in the slot.

In order to facilitate the holding of the cutter assembly 10 when using it, the cutter assembly includes an L-shaped holder 28, with the long leg 29 of the L being knurled to facilitate gripping by the user and being adapted to mount to the support 11. More specifically, the support 11 includes a mounting post 31 extending upwardly and a pair of ribs 32 extending rearwardly and laterally from a central web 33 connected to the post 31. In order to facilitate assembly, the holder 28 is comprised of two halves **28*a*, 28*b*, each of which includes a horizontally extending slot 34 through which a respective one of the ribs 32 extends. Each of the halves 28*a*, 28*b* also includes a vertically extending slot 35 shaped to fit over the post 31. The short leg 36 of the L-shaped holder 28 includes a trapezoidal opening 37 and an adjoining undercut or recessed border 39 which together define a frame for receiving a magnifying glass 40. Alternatively, the magnifying glass 40 may be omitted, in which case the opening 37 serves as a hanger so that the cutter assembly 10** may be hung from hooks or the like for display purposes and may be attached to a key ring or the like.

The support 11 includes a locking element in the form of a trapezoidal projection 38 which cooperates with a correspondingly shaped recess (not shown) in one of the holder halves 28*a*, 28*b* to firmly attached that half to the support 11. This, in turn, together with the insertion of the mounting post 31 in the vertically extending slots 35, and the insertion of the ribs 32 in the horizontally extending slots 34, serves to firmly attach the holder 28 to the support 11.

All of the component parts of the cutter assembly are advantageously formed of plastic except for the blade itself and, therefore, may be inexpensively manufactured. Additionally, the cutting assembly is easily assembled by placing the two halves 28*a*, 28*b* of the holder 28 onto the support 11, the blade 14 into the slot 12 and the retainer 26 into the recess 12. The overall dimensions of the cutter assembly 10 are small so that the cutter assembly may be easily carried on one's person in a pocket or a pocketbook. For example, the length of the cutter assembly, that is, the direction extending from left to right in FIG. 1 may be in the order of 2 to 2½ inches.

In use, the cutter assembly 10 is gripped by the holder and the outline of an item to be cut is traced with the blade while applying slight pressure thereto. As will be appreciated, no matter how irregularly shaped the item is, since it merely has to be traced with the cutter assembly, it can be cut very simply and with very little effort. Additionally, while cutting, the tip 19 of the blade 14 is urged outwardly of the support 11 and prevented from riding upwardly by the combined action of the finger 22 and the pin 25.

Since only a small portion of the blade 14, i.e., the tip 19, protrudes, there is little or no danger of the blade being broken or of causing injury to a child or any other user. Additionally, because only the tip 19 projects, items can be cut out from the top page of a stack of pages without cutting an underlying page.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A cutter assembly comprising:

a support;

a slot in the support for receiving a cutting blade, the cutting blade having a cutting edge at one end thereof, the slot being shaped to receive the blade such that only a portion of the cutting edge of the blade extends from the support;

means including a flexible finger formed integrally in the support for urging the cutting blade outward of the support; and means for retaining the blade in the slot.

2. The cutter assembly of claim 1, wherein the blade is trapezoidal shaped and the slot has a corresponding shape.

3. The cutter assembly of claim 2, wherein the slot extends to the edge of the support and has an opening through which the portion of the blade extends.

4. The cutter assembly of claim 1, wherein the flexible finger cooperates with the opening in the slot so that the portion of the blade which extends, extends approximately 0.005 inches.

5. The cutter assembly of claim 1, wherein the means for retaining includes a cover plate for covering the slot.

6. The cutter assembly of claim 5, wherein the cover plate includes at least one projecting button for engagement with the blade to retain the blade in the slot.

7. The cutter assembly of claim 5, wherein the cover plate includes a depending pin for urging the finger against the blade.

8. A cutter assembly comprising:

a support;

a recess in the support;

a slot formed within the recess for receiving a cutting blade having a cutting edge and an opposite edge, the slot being shaped to receive the blade such that only a portion of the blade extends from the support;

a U-shaped channel formed adjacent to the slot, the U-shaped channel including a pair of legs defining a flexible finger projecting adjacent the slot therebetween and spaced such that when the blade is received within the slot, the finger is in engagement with the opposite edge thereof; and a cover plate shaped to fit within the recess for retaining the blade within the slot, the cover plate having a pin projecting therefrom dimensioned to be received within the leg of the U-shaped channel on the side of the finger opposite the side in engagement with the blade so as to maintain the finger in engagement with the blade, the cover plate further including at least one projecting button for engagement with the surface of the blade to retain the blade within the slot.

9. The cutter assembly of claim 8, for accommodating blades of varying lengths, wherein for each blade the flexible finger is in engagement with the opposite edge of the blade regardless of the length thereof.

10. The cutter assembly of claim 9, in which the holder is L-shaped with one leg of the L-shaped holder being knurled and the other leg having an opening therein.

11. The cutter assembly of claim 10, further comprising a magnifying glass received in the opening.

12. The cutter assembly of claim 9, further including a holder connected to the support for holding the cutter assembly in operation.

13. The cutter assembly of claim 12, wherein the holder is comprised of two halves.

14. The cutter assembly of claim 13, wherein the support includes mounting means for connecting each half of the holder to the support.

15. The cutter assembly of claim 14, wherein the mounting means includes a post and extending ribs and each half of the holder has a slot for receiving one of the ribs.

* * * * *

UNITED STATES PATENT AND TRADEMARK OFFICE

CERTIFICATE OF CORRECTION

PATENT NO. : 5,475,928
DATED : December 19, 1995
INVENTOR(S) : Georg Augustin

It is certified that error appears in the above-identified patent and that said Letters Patent is hereby corrected as shown below:

The Title page, showing the illustrative figure,should be deleted to be replaced with the attached Title page.

Figure 4:
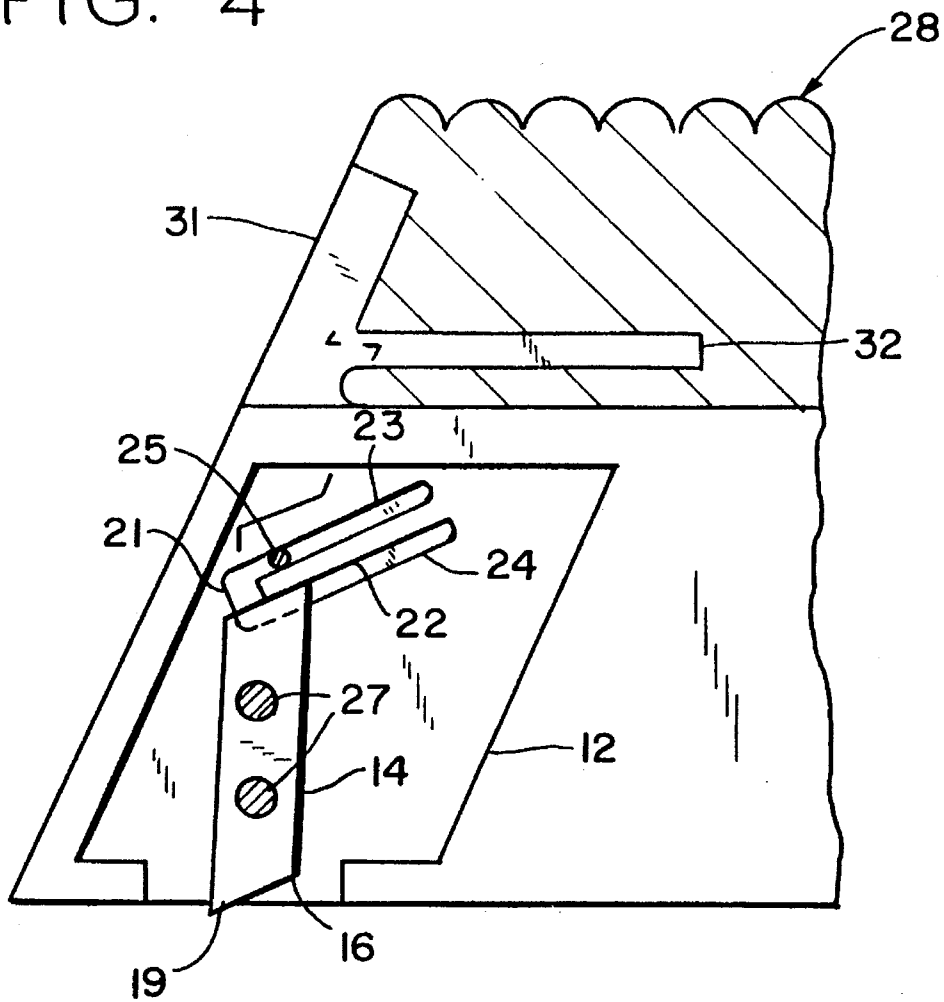
FIG. 4 is an enlarged fragmentary section, with parts removed for the sake of clarity, of a portion of the cutter assembly of FIG. 1.
Figure 1:
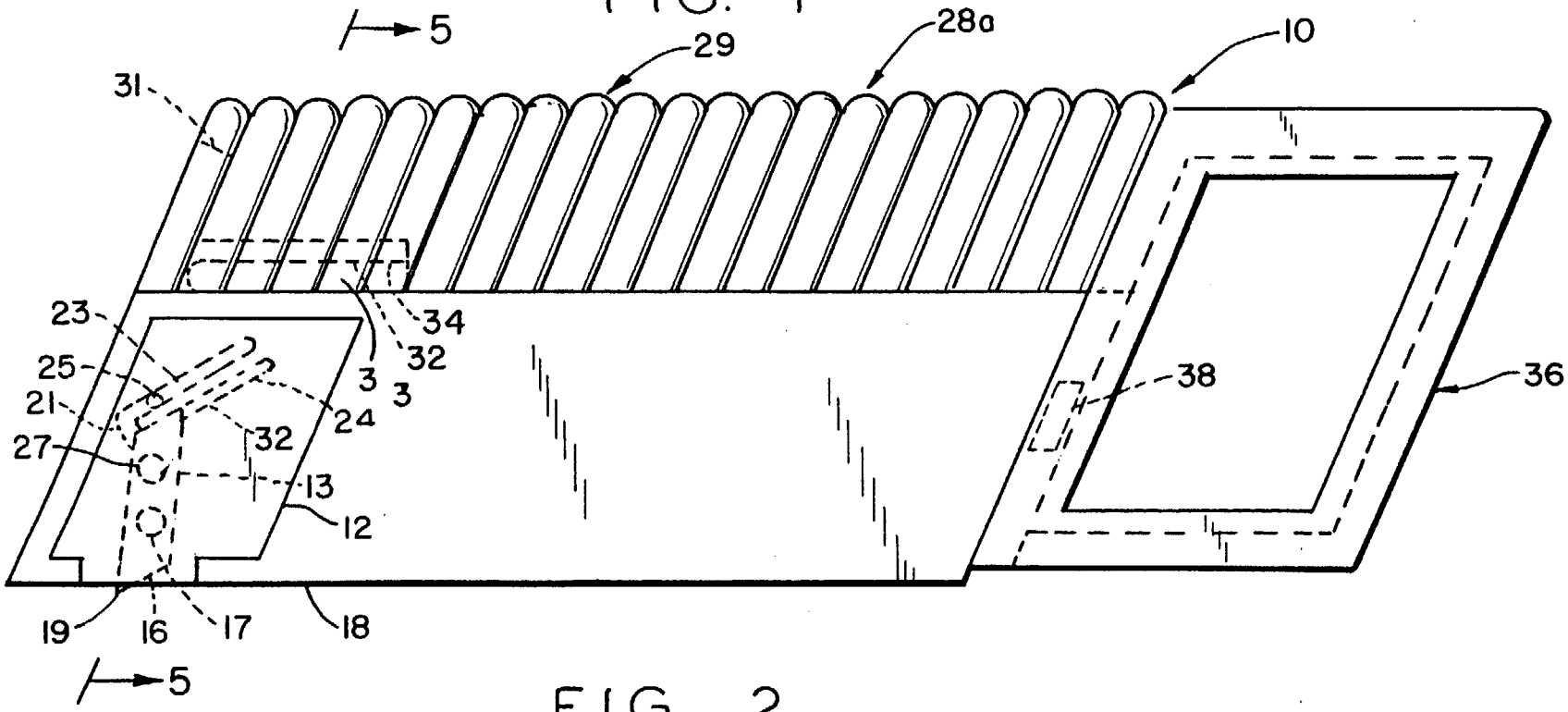
Figure 2:
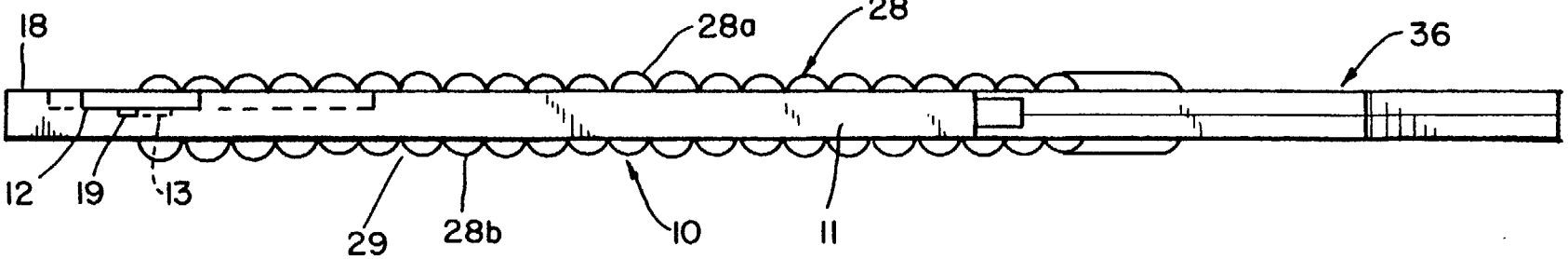
Figure 5:
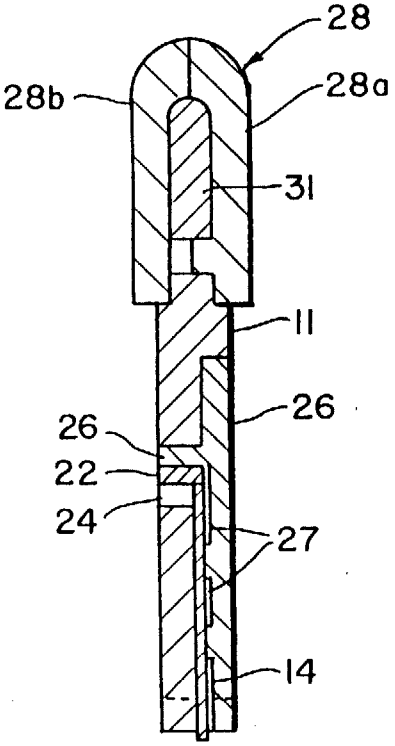
Figure 4:
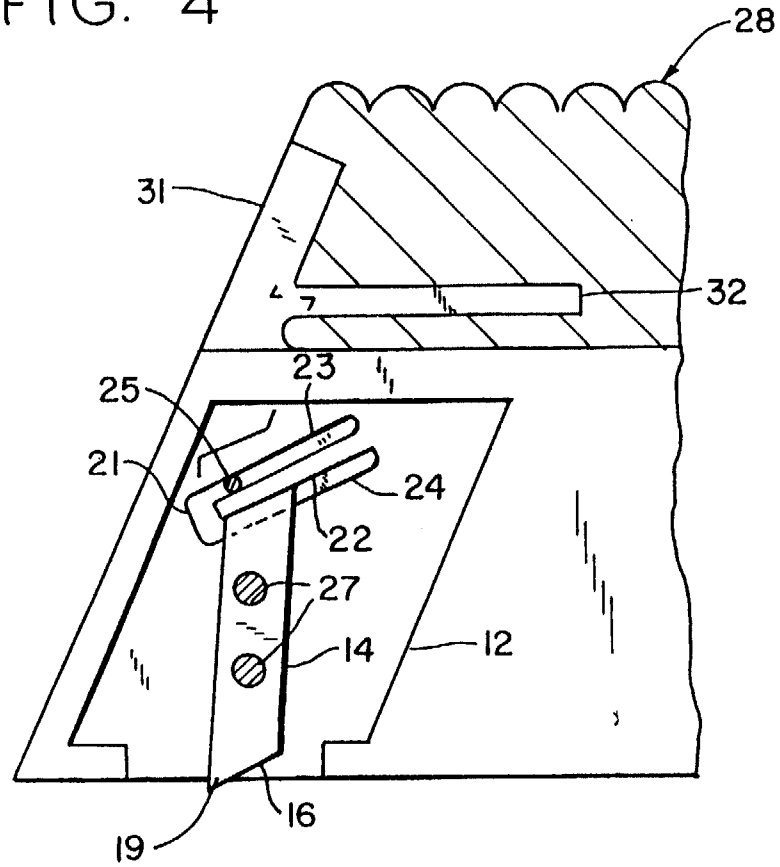

Drawings:

The Drawing sheet, consisting of Fig. 1 and 4 should be deleted to be replaced with the drawing sheets, consisting of Fig. 1 and 4 as shown on the attached sheets.

Signed and Sealed this

Sixteenth Day of September, 1997

*Attest:*

Bruce Lehman

BRUCE LEHMAN

*Attesting Officer*

*Commissioner of Patents and Trademarks*

United States Patent [19]

Augustin

[11] Patent Number: 5,475,928

[45] Date of Patent: Dec. 19, 1995

[54] CUTTER ASSEMBLY

[76] Inventor: Georg Augustin, 41 Waldweg Dr., Sparrowbush, N.Y. 12780

[21] Appl. No.: 174,980

[22] Filed: Dec. 29, 1993

[51] Int. Cl.[6] ..... B26B 3/08

[52] U.S. Cl. ..... 30/294; 30/317; 30/337; 30/2; 30/123

[58] Field of Search ..... 30/2, 286, 293, 30/294, 314, 317, 320, 329, 337, 123

[56] References Cited

U.S. PATENT DOCUMENTS

| | | | |
|---|---|---|---|
| 3,432,926 | 3/1969 | Kristal | 30/294 |
| 4,139,939 | 2/1979 | Crooks | 30/2 |
| 4,620,368 | 11/1986 | Bowman | 30/294 |

*Primary Examiner*—Rinaldi I. Rada
*Assistant Examiner*—Jay A. Stelacone
*Attorney, Agent, or Firm*—Ostrolenk, Faber, Gerb & Soffen

[57] ABSTRACT

A cutter assembly which includes a support, a recess in the support, a slot formed within the recess for receiving a cutting blade having a cutting edge such that only the tip of the cutting edge extends from the support. A U-shaped channel adjacent to the slot defines a flexible finger in engagement with the blade. A cover plate shaped to fit within the recess retains the blade within the slot. The cover plate has a pin projecting therefrom which is dimensioned to be received within a distal leg of the U-shaped channel so as to maintain the finger in engagement with the blade and at least one projecting button for engagement with the surface of the blade to retain the blade within the slot.

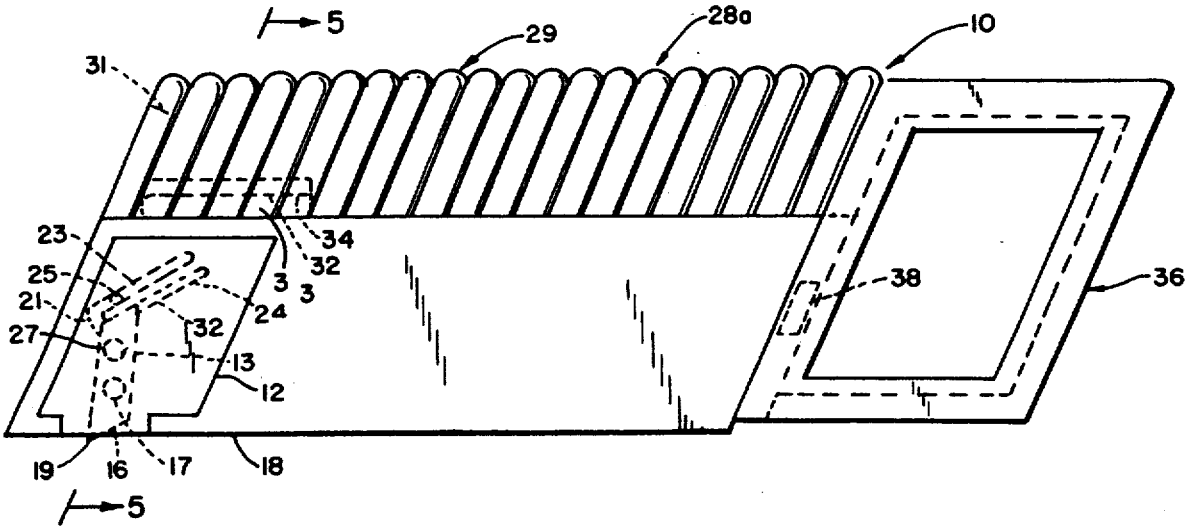

15 Claims, 3 Drawing Sheets